US005991584A

United States Patent [19]

Meyer et al.

[11] Patent Number: 5,991,584

[45] Date of Patent: Nov. 23, 1999

[54] TONER CARTRIDGE ASSEMBLY

[75] Inventors: Merle L. Meyer, Burnsville; John V. Ahart, Bloomington; Steven A. Thompson, Golden Valley, all of Minn.

[73] Assignee: Katun Coporation, Minneapolis, Minn.

[21] Appl. No.: 09/167,922

[22] Filed: Oct. 7, 1998

[51] Int. Cl.[6] ..... G03G 15/08

[52] U.S. Cl. ..... 399/262; 222/DIG. 1; 399/120

[58] Field of Search ..... 399/119, 120, 399/258, 260, 262, 263; 220/211, 253; 222/DIG. 1, 167; 141/363, 364

[56] References Cited

U.S. PATENT DOCUMENTS

| | | | |
|---|---|---|---|
| 5,441,177 | 8/1995 | Yanagisawa | 222/DIG. 1 |
| 5,669,044 | 9/1997 | Cuthbert | 399/120 |
| 5,722,014 | 2/1998 | Fike | 399/119 |
| 5,794,108 | 8/1998 | Yoshizawa et al. | 399/262 |

*Primary Examiner*—Matthew S. Smith
*Assistant Examiner*—Hoan Tran
*Attorney, Agent, or Firm*—Schwegman, Lundberg, Woessner and Kluth

[57] ABSTRACT

A toner cartridge assembly is provided including a cartridge rotatably mounted with a cap component. The cap component has an opening and a sweeper assembly rotatably coupled therewith. The cartridge has a sealing area on one end which seals the opening of the cap component. Longitudinal toner guiding ribs are provided on the cartridge for agitating the toner to be guided by the internal surface of the cartridge. A safety ring is provided on an external surface of the cartridge, and has a gap therein. The safety ring prevents removal of the toner cartridge assembly due to engaging components of the hopper. The cartridge assembly can be removed from the hopper when the gap of the ring is aligned with the engaging components, which also simultaneously requires the sealing area of the cartridge to cover the opening of the cap component.

28 Claims, 6 Drawing Sheets

TONER CARTRIDGE ASSEMBLY

FIELD OF THE INVENTION

The present invention relates generally to containers for developer. More particularly, it pertains to containers for supplying toner to an electrostatic image forming apparatus.

BACKGROUND OF THE INVENTION

The developing unit of an electrostatic image forming apparatus has a toner hopper for storing supply toner. In order to supply toner to the hopper, a toner cartridge is removably coupled with or proximate to the toner hopper. When the supply of toner has become exhausted, the toner cartridge is replaced with a new toner cartridge. Replacement of toner cartridges, frequently conducted in work areas, becomes problematic since the toner is typically supplied as a powder in small particles which can easily soil a person's clothing or hands and the surrounding area, which is undesirable in an office environment. As a result, toner cartridges have been provided with sealing devices to prevent unnecessary or inadvertent scattering of toner.

One example of a sealing device is an elastic sheet which removably covers a toner supplying aperture formed in the bottom of a toner cartridge. The sheet is removed, however, toner attached to the sheet scatters inside and outside of the image forming apparatus. In addition, once the plastic sheet has been removed, it cannot be re-attached to cover the opening if necessary. Thus, if a container is inadvertently opened, it cannot be easily resealed.

Another example of a sealing device provided with a toner cartridge is made by the Nashua Corporation of Nashua, N.H. In the Nashua device, an internal shutter is provided which is integral with the cartridge. A cap disposed over the cartridge has an opening which allows toner to be distributed therethrough or sealed when the internal shutter is disposed over the opening. To prevent distribution of toner through the opening, the operator must carefully align the opening of the cap with the internal shutter of the cartridge. However, sealing devices which rely on the operator to open and close the sealing device can result in mistaken opening of a toner cartridge, or removal of a toner cartridge with an open end, whereby toner powder is inadvertently distributed on the operator and the machine.

Accordingly, what is needed is a toner container assembly which securely and effectively seals the container and can be re-sealed in case of inadvertent opening. What is further needed is a toner container assembly which prevents operator error in opening and closing openings and/or sealing devices of the toner container assembly.

SUMMARY OF THE INVENTION

A toner cartridge assembly is provided for use with an image developing device. The toner cartridge assembly includes, in one embodiment, a cap component having an opening therein, where at least one anti-rotation feature is associated on the cap component. A cartridge having an elongate cylindrical structure is, in one embodiment, rotatably coupled with the cap component. The cartridge, which extends from a first open end to a second closed end, has a sealing area covering a portion of the first open end and rotates as the cartridge rotates. The sealing area, in one embodiment, is larger in area than the opening of the cap component and covers the opening during removal of the toner cartridge assembly from a hopper.

In another embodiment, a cartridge assembly is provided which includes a cartridge having an elongate cylindrical structure. The cartridge has a first open end which has a sealing area covering at least a portion of the first open end. In addition, the cartridge assembly includes at least one locking feature formed on the cartridge. Disposed longitudinally along the cylindrical structure is an agitating rib for facilitating movement of the toner. In yet another embodiment, the cartridge includes a cartridge driving assembly which is coupled with the cartridge.

In another configuration, a toner cartridge assembly is provided with a cap component having at least one anti-rotation feature. An elongate cylindrical cartridge is rotatably coupled with the cap component, and coupled with the cartridge is at least one locking feature. In one embodiment, the locking feature includes at least one safety ring coupled with the cartridge, where the safety ring has a gap therein for clearing structure of a cartridge mount. In another configuration, a projection is disposed within the gap of the safety ring and aids in preventing rotation of the safety ring. In another embodiment, the toner cartridge assembly includes a sweeper assembly. The sweeper assembly, in one embodiment, works in conjunction with a lip formed on the cap component. The sweeper assembly includes, in one embodiment, an actuation arm and a leg member. The leg member removes additional toner deposited on the lip before the toner cartridge assembly is removed from the hopper. In yet another configuration, a gasket is provided with the cap component and aids in preventing leakage of toner from the cartridge during and after use.

The present invention provides many new advantages including preventing an operator from inadvertently removing a toner receptacle from the machine before the opening of the cartridge is closed. This new configuration ensures that the opening is always closed before an operator removes the cartridge from the machine. This reduces the potential for damage to clothing of the operator, the copy machine, and reduces the amount of toner powder which is released into the environment. In addition, the sweeper wipes away excess material on the lip before the toner receptacle is removed from the hopper. This ensures no residual toner is left on the cap assembly as the toner cartridge assembly is removed from the machine.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims and their equivalents.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the spirit and scope of the present invention. Therefore, the following detailed description is not to be taken in a limiting sense, and the scope of the present invention is defined by the appended claims and their equivalents.

Figure 1:
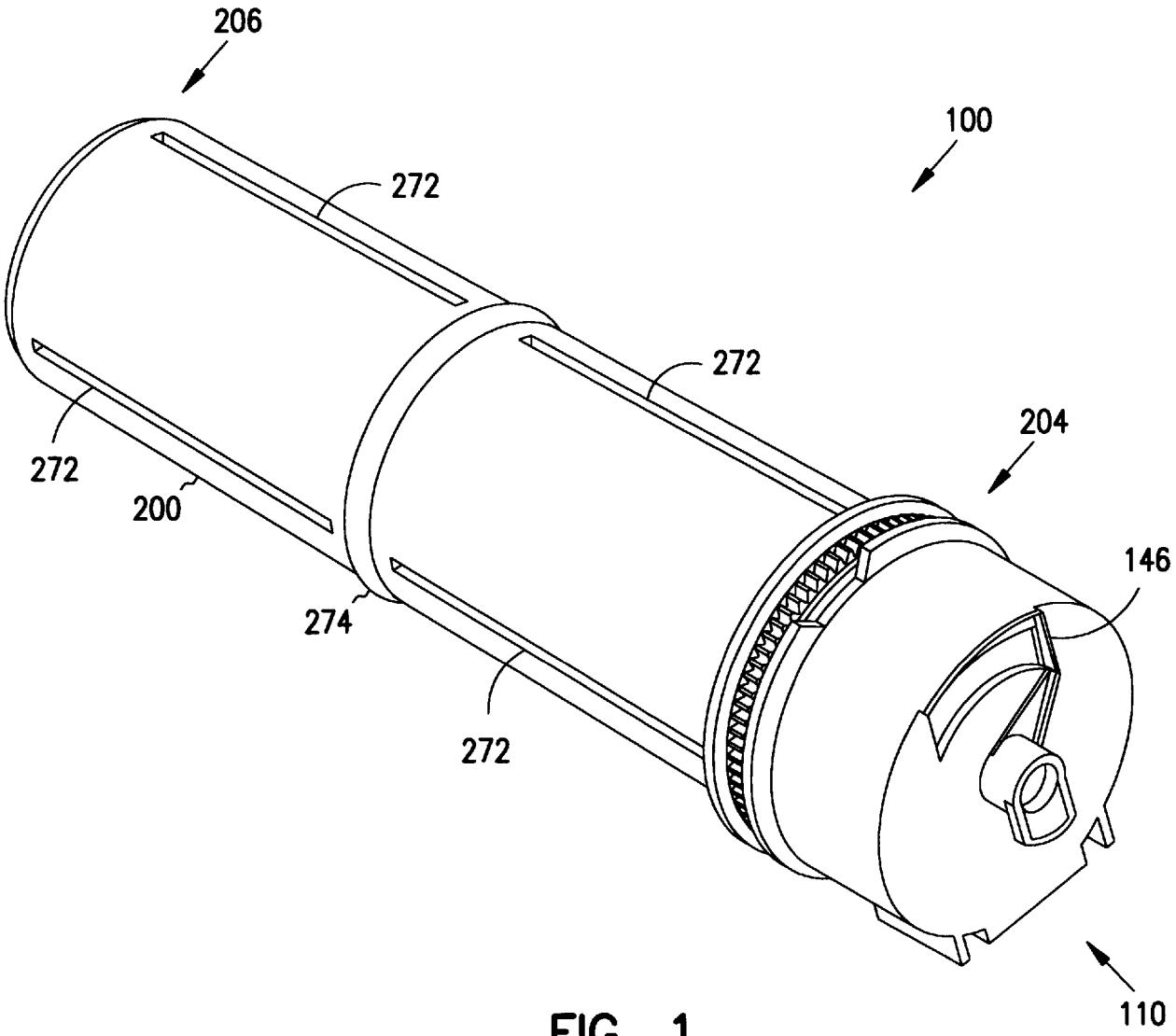
FIG. 1 is a perspective view illustrating a toner cartridge assembly constructed in accordance with one embodiment of the present invention.

As shown in FIG. 1, a toner cartridge assembly 100 is provided which includes, in one embodiment, a cap assembly 110 and a cartridge 200. The cap assembly 110 is rotatably coupled with the cartridge 200. The toner cartridge assembly 100 is adapted for use with a cartridge mount 300 (FIG. 4), as will be further described below.

Figure 2:
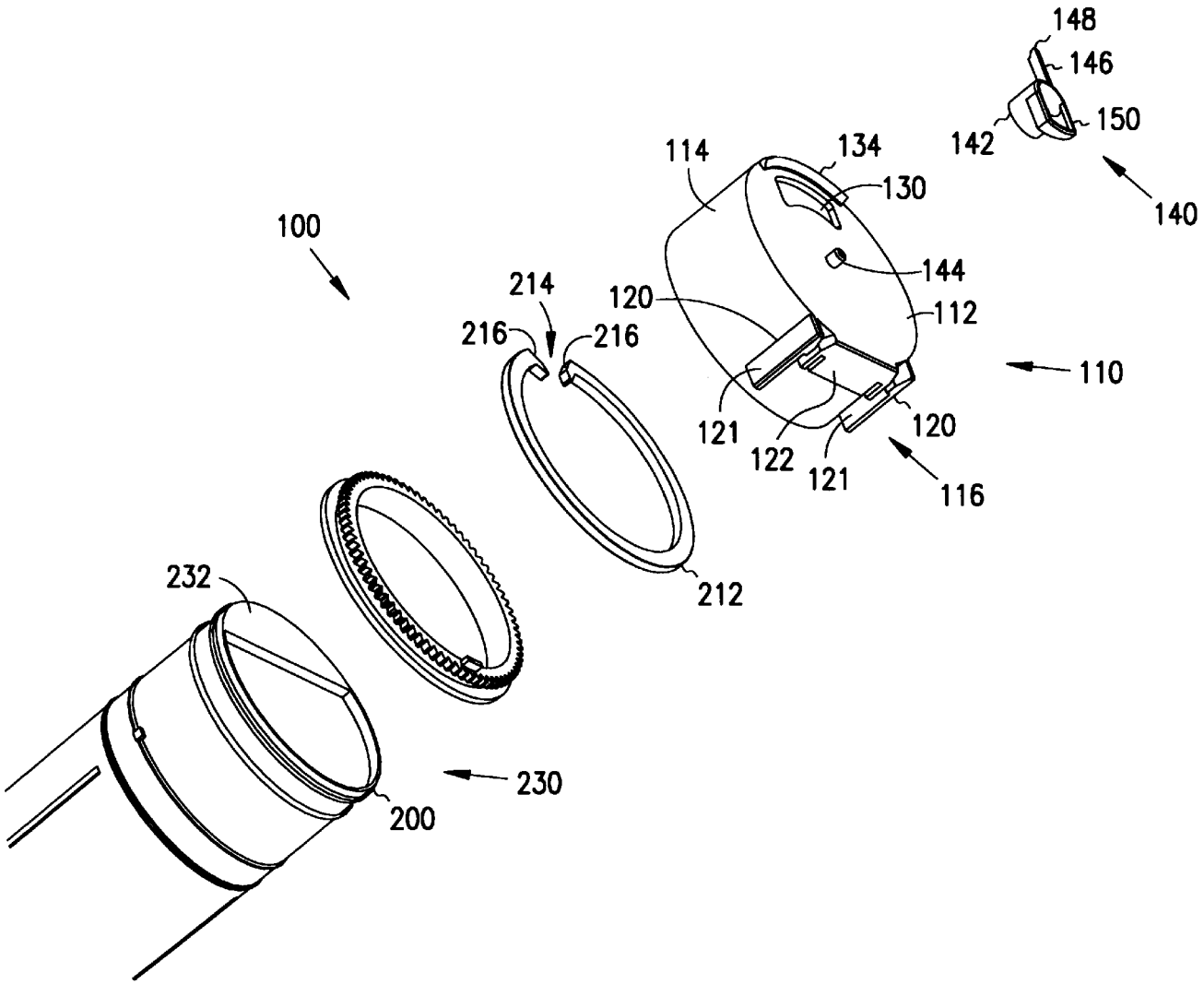
FIG. 2 is an exploded perspective view illustrating a toner cartridge assembly constructed in accordance with one embodiment of the present invention.

FIG. 2 illustrates the toner cartridge assembly 100 in an exploded view, and in greater detail. The cap assembly 110 has a cup-like shape, and an end face 112. In addition, the cap assembly 110 includes a sidewall structure 114 having at least one anti-rotation feature 116 associated therewith. In one configuration, the at least one anti-rotation feature 116 is formed on the sidewall structure. In another embodiment, the anti-rotation feature 116 comprises portions 120. The portions 120, in one embodiment, extend away from the sidewall structure 114 and form flat surfaces 121. In addition, the anti-rotation feature 116 can also include a flat 122 formed as a part of the sidewall structure 114. For the various embodiments of construction described, the anti-rotation feature 116 engages with a portion of the cartridge mount 300 (FIGS. 4, 5A and 5B) to prevent the rotation and lateral movement of the cap assembly 110, as will be further described below.

The end face 112 of the cap assembly 110 also includes an opening 130. The opening 130 allows for toner contained within the cartridge 200 to be distributed through the opening 130 to the toner-replenishing device (not shown). The opening 130 comprises a number of shapes and configurations, depending on the configuration. In one embodiment, the opening 130 comprises a square-shaped opening. Disposed adjacent to the opening 130, in one embodiment, is a lip 134. In one embodiment, the lip 134 has a beveled profile facilitating the passage of toner thereover. The lip 134 further facilitates the distribution of the toner from the cartridge 200 through the cap assembly 110.

In another embodiment, the cap assembly 110 includes a sweeper assembly 140. The sweeper assembly 140 includes a sweeper 142 which is rotatably coupled with the cap assembly 110. The cap assembly 110, in one embodiment, includes a boss 144 disposed on the end face 112 to engage with the sweeper 142. The sweeper 142 is rotatably coupled with the boss 144. The sweeper 142 is coupled with the cap assembly 110, in one embodiment, using a mechanical fastener such as a threaded fastener (not shown). In addition, the sweeper 142 also includes a leg member 146, which extends to a distal end 148. The distal end 148 of the leg member 146, in one embodiment, has a profile which corresponds to the profile of the lip 134. In another embodiment, the leg member 146 extends to a location from the sweeper 142 to proximate the lip 134 to further facilitate movement of the toner over the lip 134. The leg member 146 also aids in removing residual toner from the lip 134. The sweeper assembly 140, in another embodiment, further includes an actuation arm 150. The actuation arm 150 engages with the portion of the cartridge mount 300 to operate the sweeper assembly 140. As the actuation arm 150 is rotated, the leg member 146 also rotates. In another embodiment, a seal 222 (FIG. 3) is provided around the cap assembly 110 to prevent toner dispersement when the cartridge 200 is rotated relative to the cap assembly 110.

Figure 3:
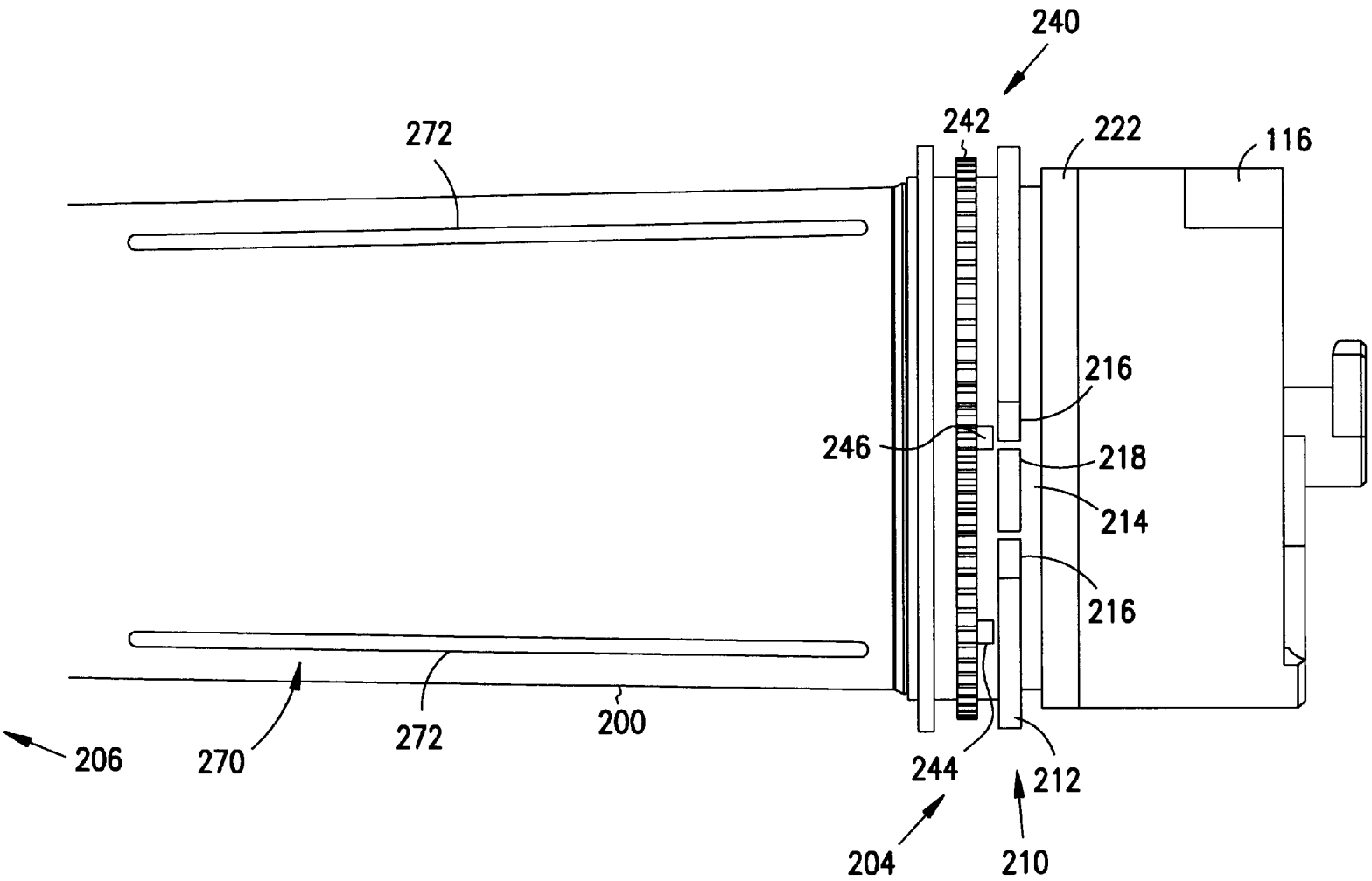
FIG. 3 is a side elevational view illustrating a toner cartridge assembly constructed in accordance with one embodiment of the present invention.

FIG. 3 illustrates the cartridge 200 in greater detail. The cartridge 200 generally has a cylindrical structure, extending from a proximal end 204 to a distal end 206 (FIG. 1). In addition, the cartridge 200 also has at least one locking feature 210, a cartridge-driving assembly 240, toner-guiding features 270, and sealing features 230 (FIG. 2).

In one embodiment, the locking features 210 comprise at least one safety ring 212. The safety ring 212, in one embodiment, is a projection which is disposed annularly around the outer surface of the cartridge 200, such that the safety ring 212 is integral with the cartridge 200. In another embodiment, the safety ring 212 is removably coupled with a portion, such as an outer surface, of the cartridge 200. In addition, the safety ring 212 has a gap 214 therein. The gap 214 allows for the cartridge 200 to be removed from the toner-replenishing device (not shown) when the cartridge 200 is in proper orientation, without interference from components of the machine, as will be further discussed below. In one embodiment, the safety ring 212 has tapered edges 216 for further facilitating the ease of removal and installation of the cartridge 200. In yet another embodiment, the locking features 210 further includes a projection 218 (FIG. 1). The projection 218, in one configuration, is disposed within the gap 214 of the safety ring 212 and facilitates preventing rotation of the safety ring 212 from a proper orientation. In one embodiment, the projection 218 is integrally formed with the cartridge 200.

The cartridge-driving assembly 240, in one embodiment, comprises a ring gear 242 and engaging features, such as a plurality of projections. The ring gear 242, in another embodiment, is rotatably coupled with the cartridge 200, and engages with a driving assembly 340 of the hopper (FIGS. 5A and 5B), and is used in combination with the plurality of projections. Having the ring gear 242 rotatably coupled with the cartridge 200 allows the operator to easily and accurately align the gap 214 of the safety ring 212 during removal of the cartridge 200 such that the opening 130 of the cap component 110 remains closed. Alternatively, in yet another embodiment, the ring gear 242 can be directly secured to the cartridge 200.

In one embodiment, a first projection 244 is provided which is coupled and rotates with the ring gear 242. The first projection 244 is coupled with the ring gear 242 such that as the ring gear 242 rotates, the first projection 244 moves with the ring gear 242. In addition, a second projection 246 is provided adjacent the safety ring 212, and is secured to the cartridge 200. The second projection 246 can be secured to the cartridge 200 by forming the second projection 246 integrally with the cartridge, or the second projection 246 can be affixed to the cartridge 200. As the first projection 244 rotates with the ring gear 242, the first projection 244 engages with the second projection 246 and rotates the cartridge 200. Thus, rotational movement of the ring gear 242 is translated into rotational movement of the cartridge 200. Although projections 244, 246 are described as one embodiment of the engaging features, other designs are possible and are considered within the scope of the invention. For instance, the engaging features can also comprise a mating coupling or other equivalents.

The cartridge 200 also includes toner guiding features 270 for facilitating the movement of toner (not shown) through the opening of the cap assembly 110. In one embodiment, the toner guiding features 270 include at least one longitudinal rib 272. In another embodiment, more than one longitudinal rib 272 can be provided. The longitudinal rib 272 assists in agitating the toner as the cartridge 200 is rotated. The longitudinal rib 272 can also be used in combination with a tapered internal surface of the cartridge 200, which directs the toner toward the opening in the cap component 110 as the toner is being agitated by the longitudinal rib 272. In this configuration, when the cartridge 200 is placed horizontally within a replenishing device or a cartridge mount 300 (FIGS. 5A and 5B), the distal end 206 is higher than the proximal end 204 relative to the receptacle mount 300 such that a draft surface occurs between the distal end 206 and the proximal end 204 and gravity facilitates the transfer of toner out of the cartridge 200. The draft in combination with the longitudinal rib 272 further facilitates the movement of the toner towards the cap assembly 110 as the cartridge 200 is rotated. To maintain the horizontal position of the cartridge 200 during its rotation, an annular rib 274 (FIG. 1) is formed around the external surface of the cartridge 200. The annular rib 274 (FIG. 1) maintains the radial axis of the cartridge 200 in a generally horizontal position as the cartridge 200 rotates.

The cartridge 200 further includes sealing features 230 for preventing the flow of toner through the cap assembly 110 when toner is not needed. In one embodiment, the sealing features 230 include a sealing area 232 formed on the proximal end 204 of the cartridge 200. The sealing area 232 covers a portion of the proximal end 204, and in one embodiment is sized larger than the opening 130 of the cap assembly 110. The sealing area 232 is adapted to cover the opening 130 of the cap assembly 110 and prevent toner from being distributed therethrough.

Figure 4:
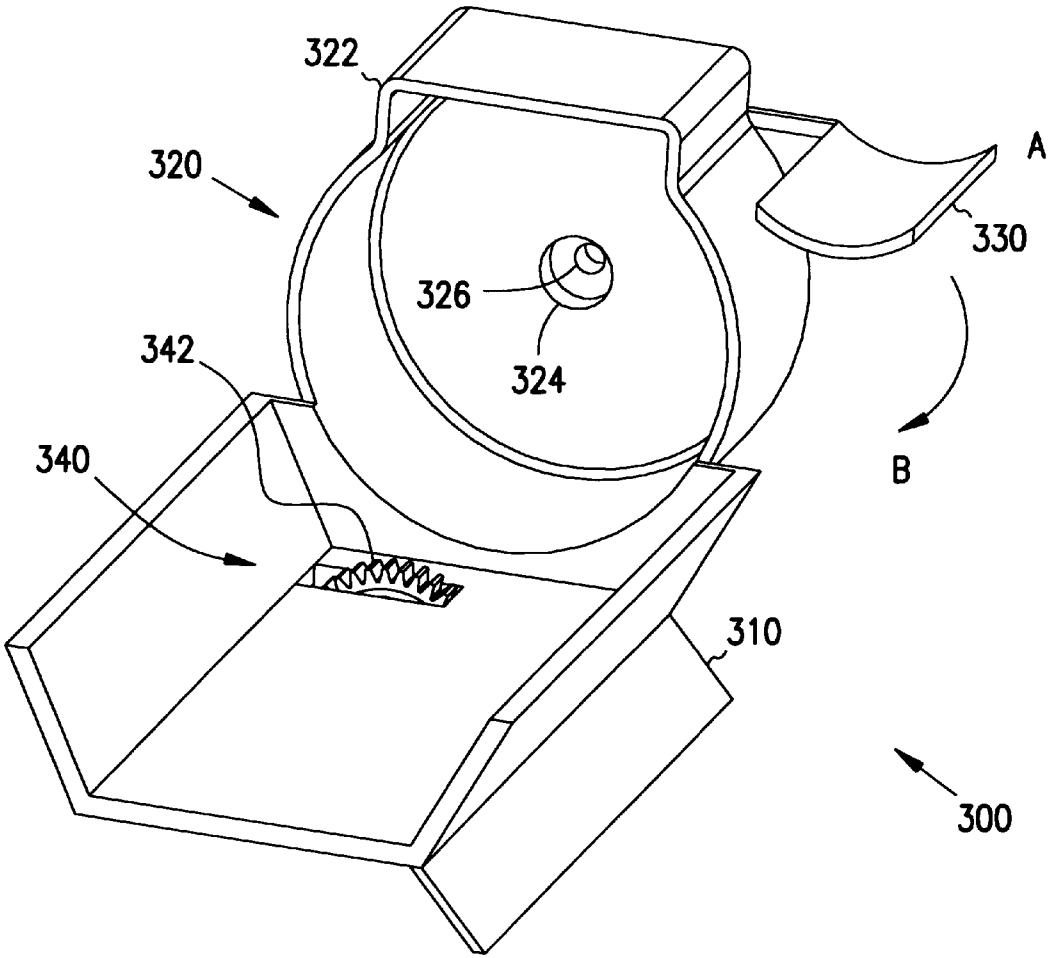
FIG. 4 is a perspective view illustrating a cartridge mount constructed in accordance with one embodiment of the present invention.
Figure 5A:
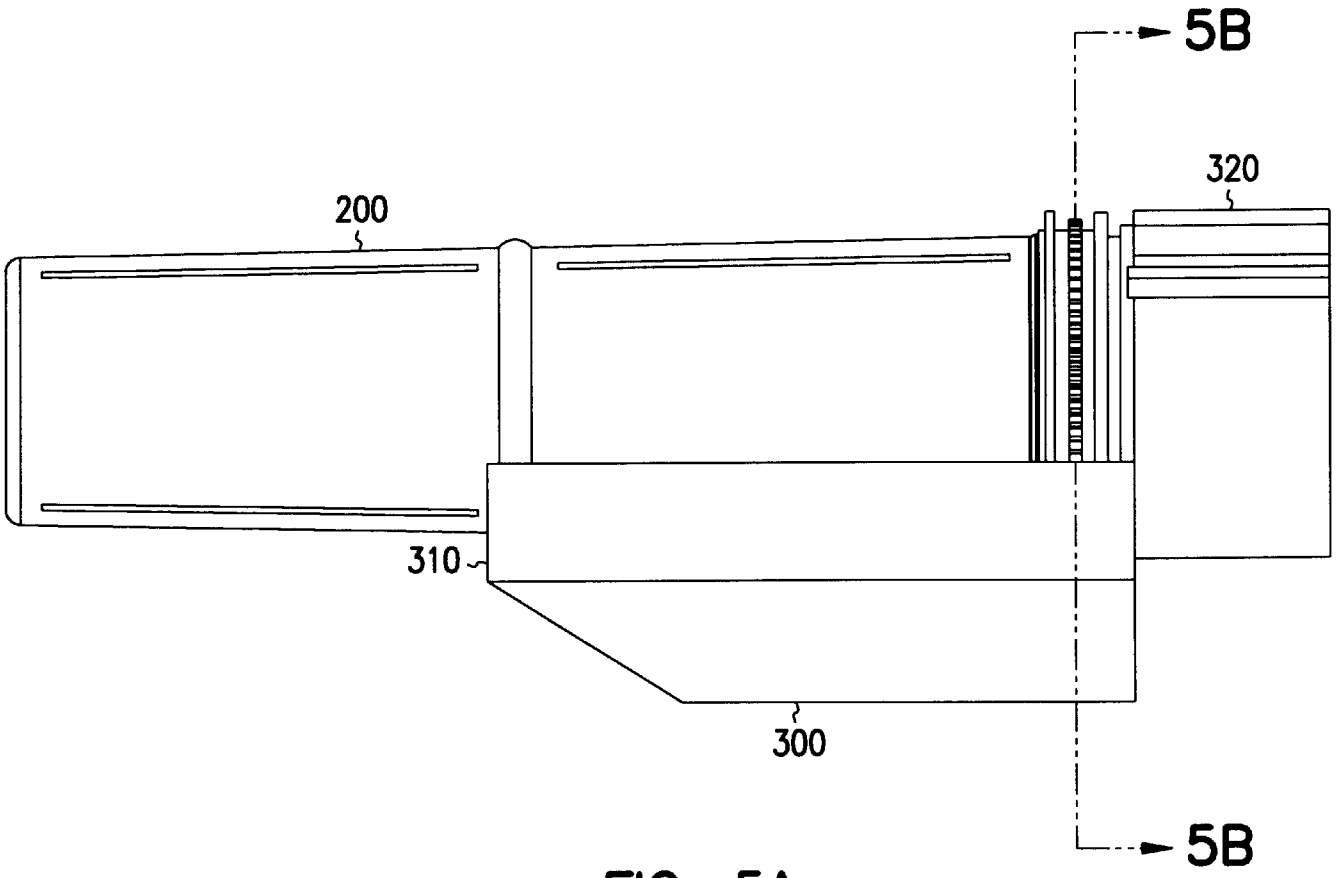
FIG. 5A is a side elevational view illustrating a toner cartridge assembly and cartridge mount constructed in accordance with one embodiment of the present invention.
Figure 5B:
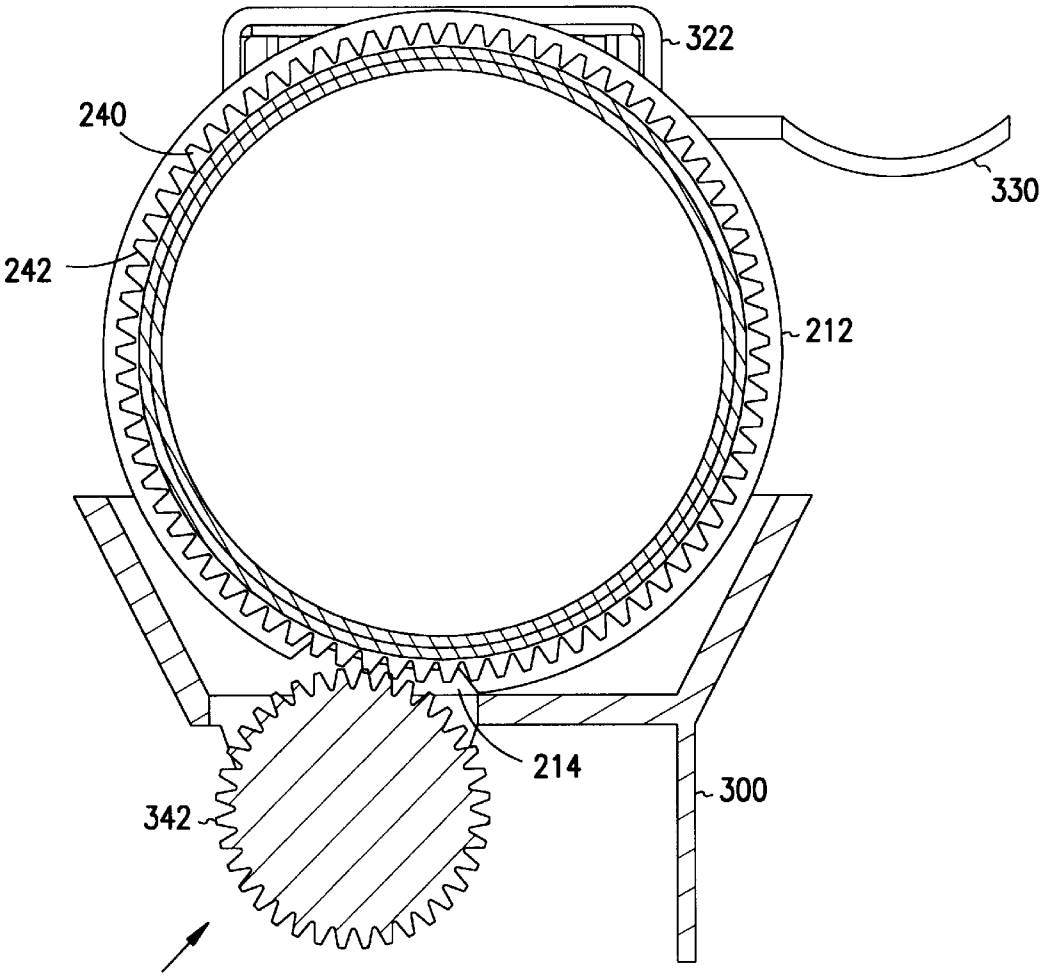
FIG. 5B is a cut-away view of FIG. 5A taken along 5B—5B illustrating the toner cartridge assembly and cartridge mount constructed in accordance with one embodiment of the present invention.

The toner cartridge assembly 100 is adapted for use with a cartridge mount 300. The toner cartridge assembly 100 can be used with several different designs of cartridge mounts, and is not limited to that which is described herein. The cartridge mount 300, as illustrated in FIG. 4, includes a hopper body 310 and a hopper driving assembly 340. The hopper body 310 is adapted for holding the cartridge 200 and the cap assembly 110 in a generally horizontal position. In addition, the hopper driving assembly 340 is adapted to rotate the cartridge 200 as the hopper body 310 holds the cap assembly 110 stationary.

The hopper body 310 includes a receiving portion 320. The receiving portion 320 is adapted to receive therein the cap assembly 110. The receiving portion 320 also includes a cutout 324 and an actuator 326. In addition, the receiving portion 320 also includes a coupling 322. The coupling 322 is adapted to mate with the anti-rotation feature 116 of the cap assembly 110. During use, the coupling 322 prevents rotation of the cap assembly 110 as the cartridge 200 is rotated. When the toner-receptacle assembly 100 is installed in the cartridge mount 300, the actuation arm 150 of the sweeper assembly 140 is received within the cutout 324 of the receiving portion 320. The actuator 326 is adapted to rotate the actuation arm 150 as will be further described below. The hopper body 310 also includes a cartridge-locking lever 330 which is operatively coupled with the actuator 326.

To install the toner-receptacle assembly 100 in the cartridge mount 300, an operator grasps the cartridge 200 and inserts the cap assembly 110 into the receiving portion 320 of the cartridge mount 300. As this is done, the gap 214 of the safety ring 212 clears the hopper drive gear 342 and then the ring gear 242 of the cartridge 200 engages with the hopper drive gear 342 of the cartridge mount 300. In addition, the actuation arm 150 is received by the cutout 324. Before toner is released into the system, the cartridge-locking lever 330 must be displaced. As the cartridge-locking lever 330 is moved from position A to position B, the actuator 326 is rotated and displaces the actuation arm 150. As the actuation arm 150 is displaced, the sweeper 142 is moved to the opposite side of the opening 130. At this point, the sealing area 230 continues to cover the opening 130, thereby preventing toner from being released.

When the machine senses it is in need of additional toner, a signal is sent to rotate the hopper-driving assembly 340. As the hopper drive gear 342 is rotated, it drives the cartridge-driving assembly 240. As the ring gear 242 is turned by the hopper drive gear 342, the first projection 244 engages with the second projection 246 adjacent the safety ring 212 and rotates the cartridge 200. As the cartridge 200 begins to rotate, the sealing area 230 uncovers the opening of the cap assembly 110. As the opening is uncovered, toner is dispensed from the cartridge 200 into the machine. Toner is continually dispensed as the cartridge 200 is rotated. While toner is being dispensed and the opening 130 is uncovered, no clearance is provided between the safety ring 212 and the hopper drive gear 342 which blocks movement of the safety ring 212 and the cartridge 200. A user is prevented from removing the toner-receptacle assembly 100 from the cartridge mount 300 while the opening 130 is uncovered, thereby preventing inadvertent dispersal of toner within the machine and also on the individual.

To remove the toner-receptacle assembly 100 from the cartridge mount 300, the cartridge-locking lever 330 must first be displaced from the B to the A position. This movement disengages and moves the actuator 326 from the actuation arm 150. At this point, if the sealing area 230 is not covering the opening 130, the operator is unable to remove the toner cartridge assembly 100 from the cartridge mount 300 since the safety ring 212 of the cartridge 200 engages with the hopper drive gear 342. The user must now rotate the cartridge 200 until the safety ring 212 has the gap 214 aligned with the hopper drive gear 342. Having the gap 214 of the safety ring 212 aligned with the hopper drive gear 342 allows for the cartridge 200 to be slid over the hopper drive gear 342 without interference therefrom. As discussed above, when the gap 214 of the safety ring 212 is aligned with the hopper drive gear 342, the sealing area 230 of the cartridge 200 covers the opening 130 of the cap assembly 110. In this configuration, no toner is inadvertently dispersed from the toner cartridge assembly 100.

The present invention provides many new advantages including preventing an operator from inadvertently removing a toner receptacle from the machine before the opening is closed. This new configuration ensures that the opening is always closed before an operator removes the cartridge from the machine. This reduces the potential for damage to clothing of the operator, the copy machine, and reduces the amount of toner powder which is released into the environment. In addition, the sweeper wipes away excess material on the lip before the toner receptacle is removed from the hopper. This ensures no residual toner is left on the cap assembly 110 as the toner cartridge assembly 100 is removed from the machine.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A cartridge unit for use with a toner cartridge assembly of an image developing device, the toner cartridge assembly comprising:

a cartridge having an elongate cylindrical structure extending from a first open end to a second closed end, the cartridge adapted to rotatably couple with a cap component;

the first open end having an end surface covering a portion of the first open end;

at least one locking feature coupled with the cartridge; and at least one agitating rib longitudinally extending along the cylindrical structure of the toner bottle.

2. The cartridge assembly as recited in claim 1, wherein the locking feature comprises a safety ring disposed adjacent the external surface of the cartridge, and the safety ring has a gap therein.

3. The cartridge assembly as recited in claim 1, further comprising a cartridge driving assembly coupled with the cartridge, including a ring gear coupled with the toner bottle.

4. A toner cartridge assembly for use with an image developing device, the toner cartridge assembly comprising:

a cap component having a cylindrical structure with a side wall and a cap end surface, the cap end surface having an opening therein;

at least one anti-rotation feature associated with the cap component;

a cartridge having an elongate cylindrical structure extending from a first open end to a second closed end, the cartridge being rotatably coupled with the cap component;

the first open end having an end surface covering a portion of the first open end, the end surface being larger in area than the opening of the cap component; and at least one locking feature associated with the cartridge.

5. The toner cartridge assembly as recited in claim 4, wherein the locking feature comprises a safety ring coupled with the cartridge, the safety ring having a gap therein.

6. The toner cartridge assembly as recited in claim 5, further comprising a projection disposed within the gap of the safety ring.

7. The toner cartridge assembly as recited in claim 4, further comprising at least one agitating rib longitudinally extending along the cylindrical structure of the toner bottle.

8. The toner cartridge assembly as recited in claim 4, further comprising at least one annular rib disposed between the first end and the second end of the toner bottle, the annular rib adapted to maintain a radial axis of the toner bottle in a horizontal position.

9. The toner cartridge assembly as recited in claim 4, further comprising a cartridge driving assembly.

10. The toner cartridge assembly as recited in claim 9, wherein the cartridge driving assembly comprises a ring gear rotatably coupled with the toner bottle, the ring gear having a first projection coupled therewith, and a second projection disposed on the cartridge adjacent a safety ring.

11. The toner cartridge assembly as recited in claim 4, further comprising a sweeper rotatably coupled with the cap component, the sweeper adapted to move over the opening of the cap component.

12. The toner cartridge assembly as recited in claim 4, wherein the cartridge is tapered from the second closed end end to the first open end end.

13. The toner cartridge assembly as recited in claim 4, further comprising a gasket coupled with the cap component.

14. A toner cartridge assembly for use with an image developing device, the toner cartridge assembly comprising:

a cap component having a cylindrical structure with a side wall and a cap end surface, the cap end surface having an opening therein;

at least one anti-rotation feature coupled with the cap component;

a cartridge having an elongate cylindrical structure extending from a first open end to a second closed end, the cartridge being rotatably coupled with the cap component; and at least one safety ring coupled with the cartridge, the safety ring having a gap therein.

15. The toner cartridge assembly as recited in claim 14, wherein the first open end of the cartridge has an end surface covering a portion of the first open end, the end surface being larger in area than the opening of the cap component.

16. The toner cartridge assembly as recited in claim 14, further comprising a sweeper rotatably coupled with the cap component, the sweeper adapted to move over the opening of the cap component.

17. The toner cartridge assembly as recited in claim 14, further comprising an actuation arm operatively coupled with the sweeper.

18. A toner cartridge assembly for use with an image developing device, the toner cartridge assembly comprising:

a cap component having a cylindrical structure with a side wall and an end surface, the end surface having an opening therein, the opening being offset from a central portion of the cap component;

a sweeper rotatably coupled with a boss of the cap component, the sweeper adapted to move over the opening of the cap component, at least one anti-rotation device formed on the side wall of the cap component, the anti-rotation device adapted to prevent the cap component from rotating;

a cartridge rotatably coupled with the cap component and having a cylindrical structure extending from a first open end to a second closed end, the cartridge having a taper from the second open end to the first open end;

the first open end having an end surface covering a portion of the first open end, the end surface being larger in area than the opening of the cap component;

a plurality of agitating ribs longitudinally extending along the cylindrical structure of the toner bottle;

at least one safety ring coupled with the toner bottle, the safety ring having a gap therein; and a cartridge driving assembly coupled with the cartridge.

19. The toner cartridge as recited in claim 18, further comprising at least one annular rib disposed between the first end and the second end of the cartridge, the annular rib adapted to maintain a radial axis of the toner bottle in a substantially horizontal position while the cartridge is rotated.

20. The toner cartridge assembly as recited in claim 19, further comprising a lip formed on an edge surface of the end surface.

21. The toner cartridge assembly as recited in claim 19, wherein a distal end of the sweeper has the same profile as the lip on the cap component.

22. The toner cartridge assembly as recited in claim 19, wherein the cartridge driving assembly comprises a ring gear rotatably coupled with the cartridge, a first projection formed on the cartridge, and a second projection coupled with the ring gear which engages with the first projection formed on the cartridge when the cartridge is rotated.

23. A method for installing a toner cartridge assembly for use with an image developing device comprising:

aligning an anti-rotation feature of a toner cartridge assembly with corresponding structure of a cartridge mount, where the toner cartridge assembly comprises a cap component having a sweeper assembly and an opening therein, a cartridge having a sealing portion formed on an open end, and at least one safety ring coupled with the cartridge, the safety ring having a gap therein;

inserting the cap component into a receiving portion of the cartridge mount such that the gap of the safety ring clears a driving assembly of the cartridge mount; and actuating a lever arm of the cartridge mount to rotate the sweeper assembly.

24. A cartridge unit for use with a toner cartridge assembly of an image developing device, the toner cartridge assembly comprising:

a cartridge having an elongate cylindrical structure extending from a first open end to second closed end, the cartridge adapted to rotatably couple with a cap component;

the first open end having an end surface covering a portion of the first open end;

at least one locking feature coupled with the cartridge, wherein the locking feature comprises a safety ring disposed adjacent the external surface of the cartridge, and the safety ring has a gap therein.

25. A toner cartridge assembly for use with an image developing device, the toner cartridge assembly comprising:

a cap component having a cylindrical structure with a side wall and a cap end surface, the cap end surface having an opening therein;

at least one anti-rotation feature associated with the cap component;

a cartridge having an elongate cylindrical structure extending from a first open end to a second closed end, the cartridge being rotatably coupled with the cap component;

the first open end having an end surface covering a portion of the first open end, the end surface being larger in area than the opening of the cap component; and at least one locking feature associated with the cartridge, wherein the locking feature comprises a safety ring coupled with the cartridge, safety ring having a gap therein.

26. The toner cartridge assembly as recited in claim 25, further comprising a projection disposed within the gap of the safety ring.

27. The toner cartridge assembly as recited in claim 25, further comprising a sweeper rotatably coupled with the cap component, the sweeper adapted to move over the opening of the cap component.

28. A toner cartridge assembly for use with an image developing device, the toner cartridge assembly comprising:

a cap component having a cylindrical structure with a side wall and a cap end surface, the cap end surface having an opening therein;

at least one anti-rotation feature associated with the cap component;

a cartridge having an elongate cylindrical structure extending from a first open end to a second closed end, the cartridge being rotatably coupled with the cap component;

the first open end having an end surface covering a portion of the first open end, the end surface being larger in area than the opening of the cap component; and a cartridge driving assembly comprising a ring gear rotatably coupled with the toner bottle, the ring gear having a first projection coupled therewith, and a second projection disposed on the cartridge adjacent a safety ring.

* * * * *

UNITED STATES PATENT AND TRADEMARK OFFICE

CERTIFICATE OF CORRECTION

PATENT NO. : 5,991,584

DATED : Nov. 23, 1999

INVENTOR(S) : Merle L. Meyer et al.

It is certified that error appears in the above-identified patent and that said Letters Patent is hereby corrected as shown below:

Title page: Item [73] 'Assignee", delete "Coporation" and insert --Corporation--, therefore.

In column 4, line 35, delete "(FIG.1)" therefore.

In column 8, line 5, delete "end to the first open end end" and insert --to the first open end--, therefore.

In column 9, line 30, delete "to second" and insert --to a second--, therefore.

Signed and Sealed this

Seventh Day of November, 2000

*Attest:*

Q. TODD DICKINSON

*Attesting Officer*

*Director of Patents and Trademarks*